US005198028A

United States Patent [19]

Nakano et al.

[11] Patent Number: 5,198,028

[45] Date of Patent: Mar. 30, 1993

[54] PHOTORECEPTOR-DRUM-POSITIONING APPARATUS

[75] Inventors: Nakaya Nakano; Hitoshi Mitake; Takeshi Tanaka; Kazuyuki Shimizu, all of Hino, Japan

[73] Assignee: Konica Corporation, Tokyo, Japan

[21] Appl. No.: 669,383

[22] Filed: Mar. 14, 1991

[30] Foreign Application Priority Data

Mar. 26, 1990 [JP] Japan ..... 2-76341
Mar. 26, 1990 [JP] Japan ..... 2-76342
Mar. 26, 1990 [JP] Japan ..... 2-76345

[51] Int. Cl.[5] ..... B05C 5/02; B05C 13/02

[52] U.S. Cl. ..... 118/62; 118/410; 118/500; 118/DIG. 11; 118/DIG. 13; 414/676

[58] Field of Search ..... 118/62, 410, 419, 500, 118/DIG. 11, DIG. 12, DIG. 13; 414/676, 745.2; 29/DIG. 78; 406/87, 88, 70, 194

[56] References Cited

U.S. PATENT DOCUMENTS 1,964,167 6/1934 Needham ..... 406/194
3,782,791 1/1974 Neumann et al. ..... 406/88
4,130,676 12/1978 Ichiyanagi et al. ..... 118/405
4,957,581 9/1990 Jährig et al. ..... 156/309.9

FOREIGN PATENT DOCUMENTS 60-50537 3/1985 Japan .
60-95546 5/1985 Japan .
527356 5/1977 U.S.S.R. ..... 406/88
927720 6/1963 United Kingdom ..... 406/88

*Primary Examiner*—Michael G. Wityshyn
*Attorney, Agent, or Firm*—Frishauf, Holtz, Goodman & Woodward

[57] ABSTRACT

A position setting apparatus for positioning a drum so that it may be uniformly coated with a photosensitive coating liquid to produce a photoreceptor, wherein the position of the drum is set by centripetally blowing a pressurized fluid from a fluid outlet means directly against the drum. The drum is positioned by the balance of the pressure of the blown fluid, and the surface of the drum is thereby protected from scratching as no mechanical device is required to touch the drum during positioning.

17 Claims, 4 Drawing Sheets

PHOTORECEPTOR-DRUM-POSITIONING APPARATUS

FIELD OF THE INVENTION

The present invention relates to an apparatus for positioning, in the course of manufacture of a photoreceptor drum for electrophotography use, a cylindrical drum of the for coating by a coating solution.

BACKGROUND OF THE INVENTION

In the course of manufacture of a photoreceptor drum of an organic photoconductor type that is to be used as a photoreceptor in an electrophotographic apparatus, a photosensitive coating solution is coated on a cylindrical drum base body of the photoreceptor. When the cylindrical drum base body is coated, it is necessary that slide hoppers and the like are positioned at predetermined locations around the cylindrical drum and that the clearance between the cylindrical drum and each slide hopper in the radial direction on a sectional circle of the cylindrical drum is adjusted to be constant. In this case, the deviation of the cylindrical drum by only 0.1 mm in the radial direction can cause a great difference in the thickness of a coated layer because a coated layer is extremely thin in its necessary thickness.

It is generally known that such difference in thickness of a coated layer causes various kinds of troubles such as a change of a charged amount in the radial direction of the cylindrical drum, unevenness of sensitivity and a change of residual potential. Therefore, it is very important to position the cylindrical drum accurately.

Heretofore, as drum-positioning methods of this kind, there is known a method wherein a drum is fed continuously through coating heads being touched by position-regulating rollers provided around the drum. Alternatively, a drum is fed continuously through coating heads being touched by a group of plural driving rollers provided in the transport direction. At the same time, the relation in terms of location between an external peripheral surface of the drum and the coating head is adjusted while the coating head is moved horizontally through rollers. These methods are similar to those disclosed in Japanese Patent Publication Open to Public Inspection Nos. 60-50537 and 60-95546 (hereinafter referred to as Japanese Patent O.P.I. Publication].

In all of the conventional apparatuses, however, positioning is conducted with position-regulating rollers or with a group of driving rollers all of them contacting directly a drum. Therefore, the drum is scratched, which is a disadvantage. It is generally known that the scratch on the drum causes electrophotographic characteristics to be worsened.

On the other hand, in the apparatus disclosed in the latter publication, it is essential that the position of a drum is regulated and the position of each coating head is adjusted, but when the coating head is made to be slidable, the coating head tends to be deviated against the drum, and it is particularly difficult to keep the drum and the coating head coaxial.

SUMMARY OF THE INVENTION

A primary subject to be solved by the invention is how to position a drum without causing the drum to be scratched.

Further, when positioning a drum, the drum is required to be positioned, without being positioned by a single point in its axial direction, in a way so as to prevent the movement of the slanted drum and to thereby keep constantly a uniform clearance between the drum and a coating head. This is because a drum, when it is fed aslant, tends to move aslant in its axial direction even when the outer circumferential surface of the drum is controlled in terms of position. This in turn results in a phenomenon that the drum hits a supporting member or the drum moves without keeping a uniform clearance between the drum and the coating head, causing scratching.

Further, when drum 1 is positioned by air pressure generated from air-jetting nozzle 3 that is arranged horizontally in a process for coating a light-sensitive solution from a coating head while moving drums 1 by coupling them in succession, a part of jetted air sometimes goes up after hitting the outer surface of a drum 1 and flows toward coating head 2 to pass upward through the clearance between the outer surface of a drum 1 and coating head 2. In this case, a coating mottle or a coating defect is caused, resulting in a failure in smooth coating.

An object of the invention, therefore, is to position a drum without causing any scratch on the drum and to eliminate an adverse effect on coating conducted by a coating head. The aforesaid objects can be achieved by a photoreceptor-drum-positioning apparatus for positioning a cylindrical drum base body of a photoreceptor drum when a coating solution is coated on an external surface of said cylindrical drum base body in the course of manufacture of the photoreceptor drum, wherein there is provided a blowing means that jets a fluid against a portion not yet coated or a portion already coated on said cylindrical drum base body and thereby positions the cylindrical drum base body by means of pressure of the fluid.

This jetting means is provided at a single location on the same circumference of a circle or a plurality of jetting means are provided at some intervals in the direction of an axis of a drum base body.

DETAILED DESCRIPTION OF THE INVENTION

In the present invention, a cylindrical drum is positioned by fluid pressure which is generated when a fluid is jetted against an external surface of the cylindrical drum. Namely, when a fluid such as, for example, air is jetted against the peripheral surface of the drum, the jetting pressure neutralizes the position of the drum, thereby positioning the drum at a predetermined location thereby preventing the drum from being scratched because nothing touches the drum mechanically.

In addition the drum may be positioned through a plurality of points in the direction of an axis of the drum so that, it is possible to hold the drum in parallel with an axis of a coating head without any inclination of the drum axis, thereby preventing the phenomena whereby the drum hits the coating head and causes an uneven clearance in the circumferential direction. Thus a uniform coating thickness is achieved.

EXAMPLES

The invention will be explained in detail, referring to the examples.

Figure 1:
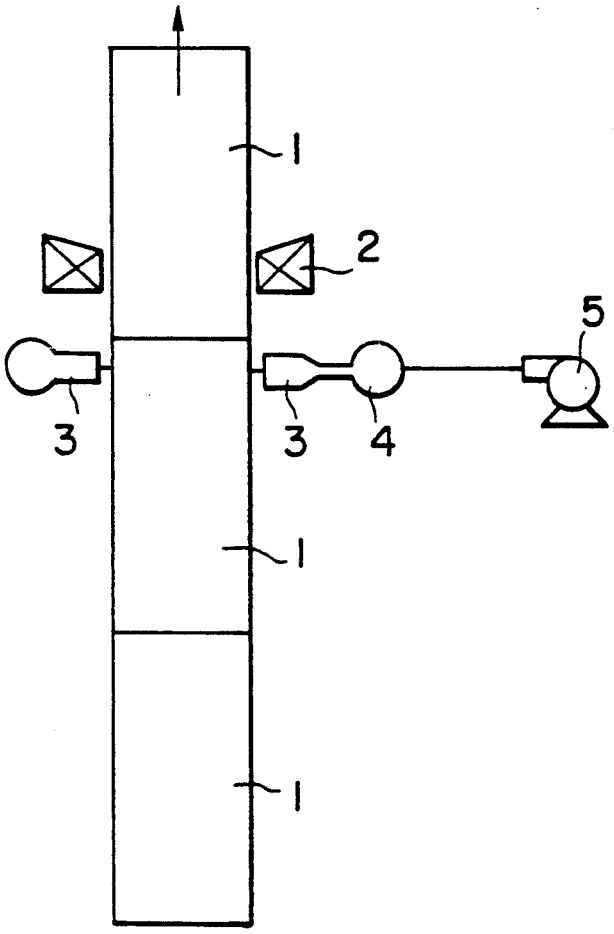
FIG. 1 is a longitudinal sectional view showing the outline of a first example of a photoreceptor-drum-positioning apparatus related to the invention.
Figure 2:
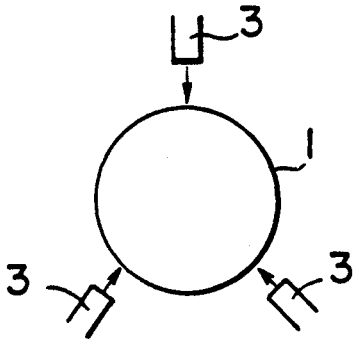
FIG. 2 is a horizontal sectional view of the first example.

FIG. 1 and FIG. 2 show the first example, and the numeral 1 is a drum base body in the shape of, for example, a hollow cylinder which can be elevated continuously by an unillustrated conveyance means such as, for example, a cylinder that pushes up the bottom surface of the drum base body.

The numeral 2 is a coating head in the shape of a ring for coating a photosensitive liquid on an external surface of drum base body 1, and it is provided fixedly for coating a photosensitive liquid by jetting the liquid continuously from an outlet formed on an internal side of the ring while drum base body 1 is ascending.

As a coating head that is a coating means used for the invention, what is disclosed in Japanese Patent O.P.I. Publication No. 189061/1983 or in Japanese Patent O.P.I. Publication No. 50537/1985 can be used if it satisfies the condition that it be located around an external surface of drum base body 1 so that it covers the drum base body and the further condition that it have a basic arrangement for coating a coating solution on an external surface of drum base body 1.

Figure 7:
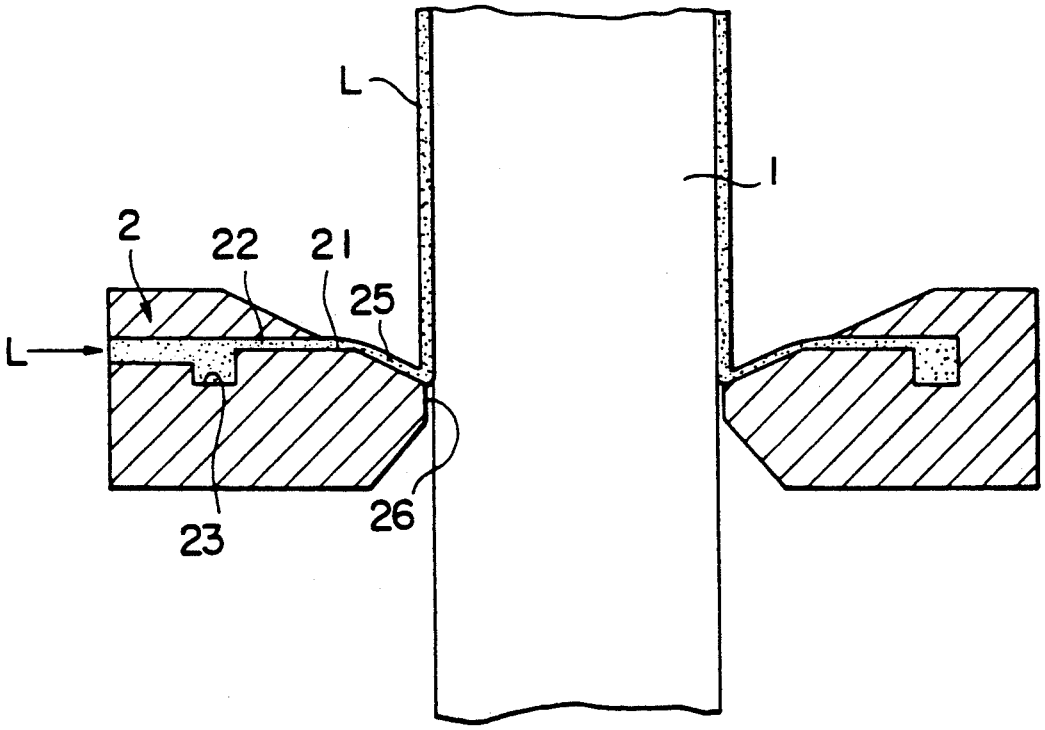
FIG. 7 is a longitudinal sectional view of an example of a coating head.

An example of the coating head mentioned above is shown in FIG. 7. This coating head 2 is a coating head of a slide hopper type.

On coating head 2, there is formed horizontally the narrow coating solution-distributing slit 22 having thereon coating solution outlet 21 facing the drum base body 1 side. The slit 22 is connected to solution-pool header 23, and the solution-pool header 23 is arranged so that photosensitive liquid L is fed to it by a force-feeding pump [not shown].

On the other hand, there is formed solution-sliding surface 25 below the coating solution outlet 21 of slit 22 so that the solution-sliding surface inclines continuously and terminates slightly larger in dimension than the outside diameter of drum base body 1. Further, lip-shaped portion 26 is formed so that it extends downward from the lower end of solution-sliding surface 25.

When such coating head 2 is used, photosensitive liquid L is ejected while drum base body 1 is elevated from slit 22 and from coating solution outlet 21 so that the liquid flows down along solution-sliding surface 25. Photosensitive liquid L arriving at lip-shaped portion 26 is coated on the external surface of drum base body 1 at a thickness equivalent to the clearance between lip-shaped portion 26 and drum base body 1.

For the purpose of feeding drum base body 1 coaxial with such coating head 2, there is provided a blowing means for positioning drum base wherein body 1 fluid pressure is utilized. In the first example shown in FIGS. 1 and 2, air-ejecting nozzles 3 are arranged horizontally to face the center axis of drum base body 1 at an interval angle of $120^0$ so that their tips are equally away, in distance, from the center axis of coating head 2, and so that each air-ejecting nozzle 3 is connected to common ring-shaped header 4. This ring-shaped header 4 is arranged so that it receives high-pressure air from compressor 5, and high-pressure air led to ring-shaped header 4 is sprayed at high speed, with constant ejecting amount and ejecting pressure, toward an external surface of drum base body 1 from each of ejecting-nozzles 3. As a result, drum base body 1 is positioned with its axis being coaxial with the center axis of coating head 2. Therefore, photosensitive liquid coming from coating head 2 can be coated on the external surface of drum base body 1 at a uniform thickness The inner diameter of the nozzles is not more than 10.0 mm and not less than 1.0 mm, and the clearance between the nozzles and the drum is not more than 1.00 mm and not less than 0.02 mm.

Figure 10:
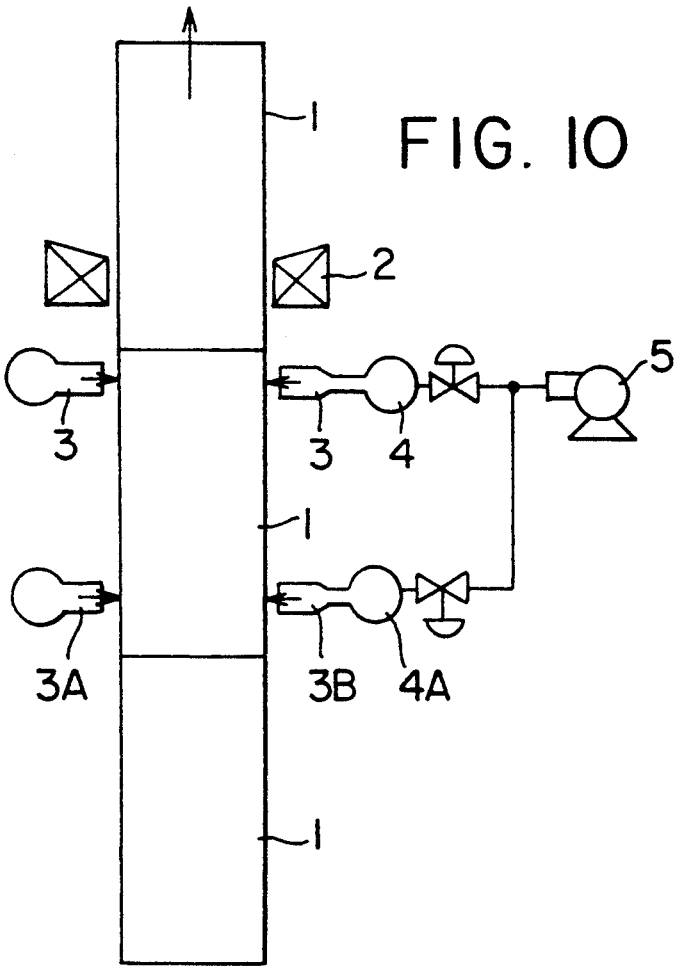
FIG. 10 is an example of a drum positioning apparatus wherein two sets of nozzles are spaced axially along the drum path.

Furthermore, in addition to a set of jetting means having jetting nozzles 3 provided at a certain location on drum 1, at least two of jetting means may be provided at other locations along the axial direction of the drum, for example, as shown in FIG. 10. In these other sets of jetting means which have the same structure, air is jetted from each jetting nozzle by means of a common compressor.

Figure 5:
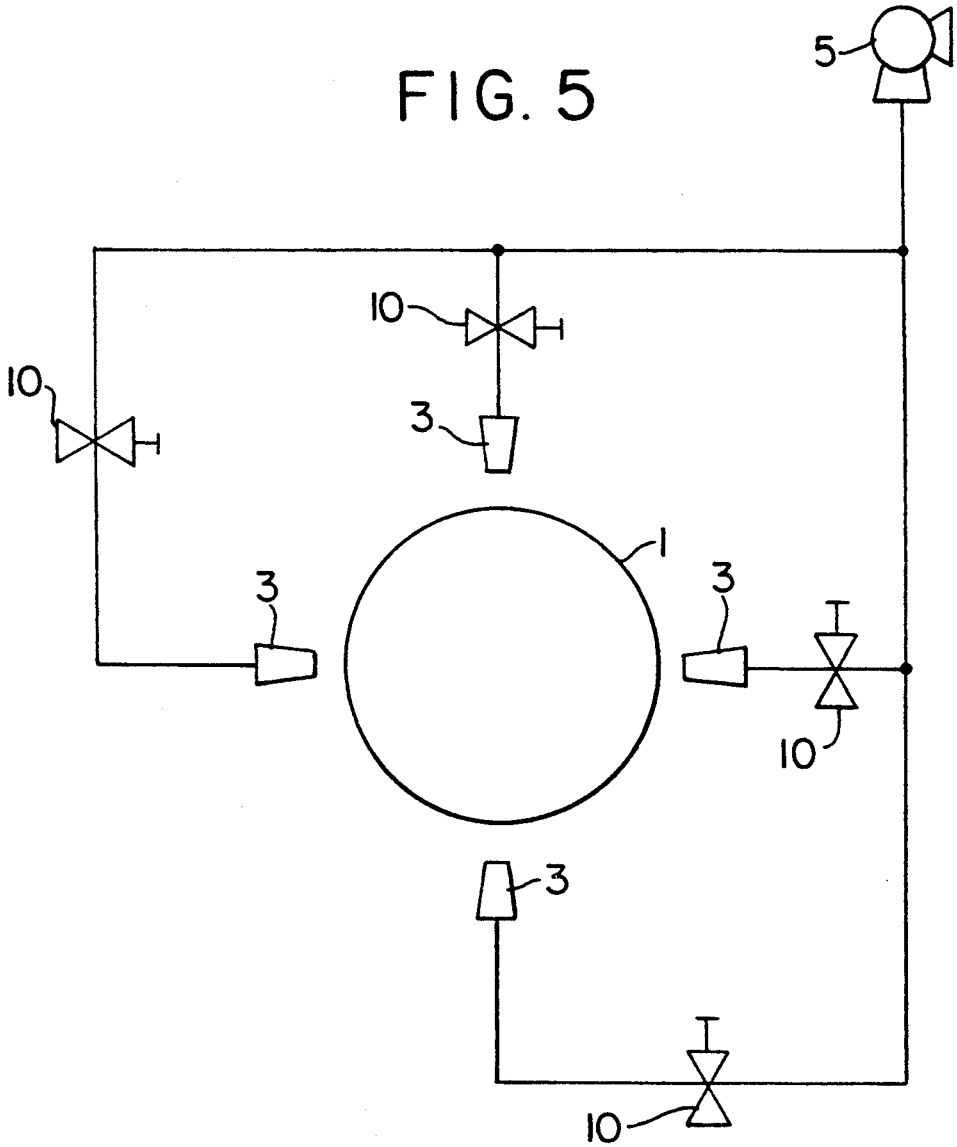
FIG. 5 is a horizontal sectional view of a fourth example.

In this case, it is possible to adjust an amount or pressure of jetted air by means of a regulating valve 10, as shown in FIG. 5, so that each set of jetting means may differ from others in terms of an amount or pressure of jetted air. It is further possible to make an air jetting position of a nozzle of each set of jetting means to be different from others by 60°, for example.

Figure 9:
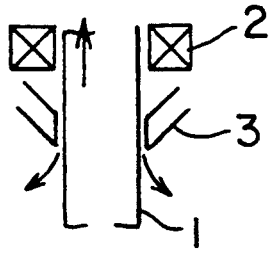
FIG. 9 is an example of a drum positioning apparatus wherein the orifice of each nozzle is inclined downward at an angle to the drum axis.

It is also possible to make the direction of air jetted from an orifice of each nozzle 3 to be inclined downward by an inclination angle up to 30°, for example, as shown in FIG. 9. Each nozzle 3 is arranged so that it may be supplied with high-pressure air from an unillustrated compressor.

Air jetted from nozzle 3 in this case, after hitting the outer surface of drum base body 1, does not go upward but does go downward without fail so as not to adversely affect the layer of light-sensitive solution coated by coating head 2, thereby preventing any coating defect.

As long as the direction of jetting from nozzle 3 is inclined, air, after hitting, never goes up.

Figure 6:
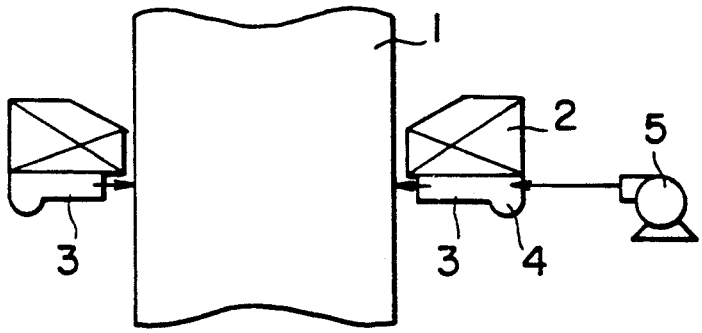
FIG. 6 is a horizontal sectional view of a fifth example.
Figure 8:
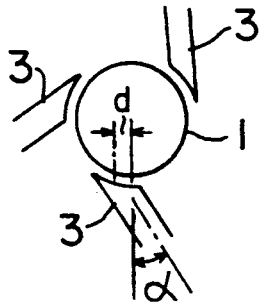
FIG. 8 is an example of a drum positioning apparatus wherein the nozzle orifices are inclined at angles deviated from a radial direction of the drum.

It is also possible to have an arrangement wherein a continuous slit 3 is provided on a ring-shaped blowing, means so that the continuous slit may face drum base body 1 and so that the direction of jetting from the slit is inclined downward. FIG. 6, for example, shows a case where the fluid outlet is a ring-shaped slit, located underneath the coater. Further, although each nozzle 3 is positioned horizontally, it is also possible to have an arrangement wherein each direction of air jetting has a deviation without pointing to the center of drum base body 1 and is inclined by a certain angle from the radial direction from the center of the drum base body, for example, as shown in FIG. 8. In this case, air jetted from nozzle 3, after it hits drum base body 1, goes mostly horizontally and never goes up.

Figure 3:
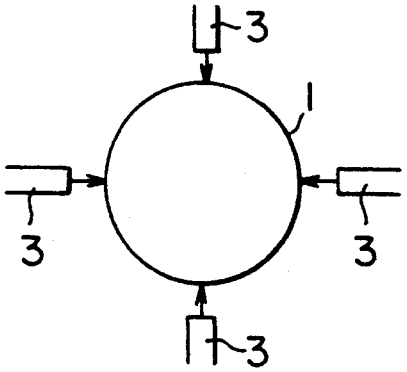
FIG. 3 is a horizontal sectional view of a second example.

FIG. 3 shows the second example wherein four air-ejecting nozzles 3 are provided around drum base body 1 with an angular interval of 90°. The number of nozzles 3 is not limited as shown in this example.

Figure 4:
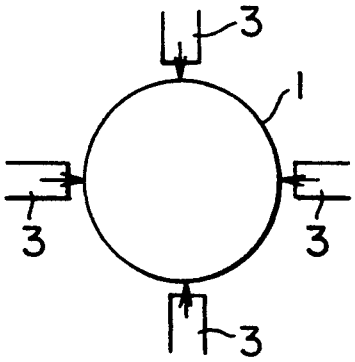
FIG. 4 is a horizontal sectional view of a third example.

FIG. 4 shows a case where the outlet nozzle 3 is shaped along the curve of the drum surface. As a photosensitive liquid, it is possible to use inorganic photosensitive materials such as zinc oxide and cadmium sulfide as well as organic photosensitive materials such as polyvinylcarbazole and trinitrofluorene both dispersed in a high molecular binder. In addition, it is also possible to use a photosensitive layer of a function-separated type wherein a charge generating layer and a charge transport layer are laminated, so as to meet the recent demand for high sensitivity and improved durability.

For example, a charge generating layer is obtained by dispersing azo pigment, quinone pigment perylene pigment, phthalocyanine pigment or anthanthrone pigment in a high molecular binder such as polycarbonate, and a charge transport layer is obtained by dispersing polycyclic aromatic compound or a nitrogen-containing cyclic compound in a high molecular binder. The thickness of a charge generating layer is 0.01-10 μm and preferably is 0.05-5 μm, while that of a charge transport layer is preferably 5-30 μm. The range of viscosity of photosensitive liquid is 0.5-700 cp and it is preferably 1-500 cp.

Further, as a hollow drum for electrophotography use, aluminum, stainless steel or plastic on which a conductive layer is formed can be used. In addition to that, it is also possible to use a hollow drum wherein a subbing layer and a charge generating layer are formed in advance.

As stated above, the invention has an advantage in that a drum can be positioned accurately without being touched and thereby without being scratched. The invention has a further advantage in that dust particles sticking to the drum are removed by sprayed air, thereby improving the coating efficiency.

What is claimed is:

1. An apparatus for positioning and uniformly coating a drum to produce a photoreceptor drum, comprising:
   - means for holding and for sliding the drum vertically in an upwardly axial direction of the drum;
   - positioning means for positioning the drum at a desired position for uniform coating thereof, said positioning means comprising fluid outlet means circumferentially positioned around the drum for jetting pressurized fluid directly onto only uncoated portions of the drum so as to maintain the drum at said desired position thereof; and
   - coating means for uniformly coating a coating solution on an external surface of the positioned drum;
   - wherein said fluid outlet means of said positioning means are arranged to jet said pressurized fluid in a direction so that said pressurized fluid flows downward after contacting the uncoated portions of the drum, thereby preventing damage to coated portions of the drum.

2. The apparatus of claim 1, wherein the fluid outlet means comprises a number of spaced apart nozzles positioned with respect to each other circumferentially around the drum at an angle of 360° degrees divided by the number of the nozzles, said number of nozzles being at least three.

3. The apparatus of claim 1, wherein the fluid outlet means comprises a number of circumferentially spaced apart nozzles.

4. The apparatus of claim 3, wherein the number of nozzles is four.

5. The apparatus of claim 3, wherein the nozzles have an inner diameter not more than 10 nm and not less than 1 mm.

6. The apparatus of claim 3, wherein said positioning means further comprises a regulating valve for controlling the amount and pressure of the fluid jetted by each nozzle.

7. The apparatus of claim 3, wherein the nozzles are positioned to jet fluid at angles deviated from a radial direction of the drum.

8. The apparatus of claim 3, wherein the number of nozzles is three.

9. The apparatus of claim 8, wherein the gas comprises air.

10. The apparatus of claim 1, wherein the fluid outlet means comprises a slit positioned circumferentially around the drum.

11. The apparatus of claim 10, wherein the slit is continuous around the drum.

12. The apparatus of claim 1, wherein the coating means includes a ring-shaped coater that centripetally ejects the coating solution onto the drum.

13. The apparatus of claim 1, wherein a clearance space is provided between the fluid outlet means and the drum, said clearance space being not more than 1 mm and not less than 0.02 mm.

14. The apparatus of claim 11, wherein the positioning means comprises at least two fluid outlet means arranged along the axial direction of the drum.

15. The apparatus of claim 1, wherein said fluid outlet means is positioned with respect to the axis of the drum at an angle from 90° degrees to 30° degrees.

16. The apparatus of claim 1, wherein said fluid outlet means is positioned with respect to the axis of the drum at an angle between 30° degrees and less than 90° degrees.

17. The apparatus of claim 1, wherein the fluid comprises a gas.

* * * * *